United States Patent [19]

Huber et al.

[11] 4,366,590

[45] Jan. 4, 1983

[54] EXPANSION JOINT

[75] Inventors: Reinhold Huber, Bülach, Switzerland; Waldemar Köster, In Tentefeld 17, D-5064 Rösrath-Forsbach, Fed. Rep. of Germany

[73] Assignee: Waldemar Köster, Rösrath-Forsbach, Fed. Rep. of Germany

[21] Appl. No.: 220,178

[22] Filed: Dec. 23, 1980

[30] Foreign Application Priority Data

Dec. 28, 1979 [DE] Fed. Rep. of Germany ..... 2952613

[51] Int. Cl.[3] ..... E01D 19/06

[52] U.S. Cl. ..... 14/16.5; 404/68; 404/64; 52/396; 52/403; 49/475

[58] Field of Search ..... 14/16.5; 404/68, 69, 404/64, 47, 65; 49/475, 487; 52/396, 403

[56] References Cited

U.S. PATENT DOCUMENTS

| | | | |
|---|---|---|---|
| 3,888,599 | 6/1975 | Reifsnyder | 404/69 |
| 3,923,411 | 12/1975 | Berghman | 404/64 |
| 3,994,609 | 11/1976 | Puccio | 52/396 |
| 4,018,539 | 4/1977 | Puccio | 404/69 |
| 4,067,660 | 1/1978 | Puccio | 404/69 |
| 4,148,167 | 4/1979 | Puccio | 52/396 |

FOREIGN PATENT DOCUMENTS

| | | | |
|---|---|---|---|
| 1784069 | 7/1971 | Fed. Rep. of Germany . | |
| 1557599 | 2/1969 | France | 404/69 |
| 1242078 | 7/1968 | United Kingdom | 52/396 |

*Primary Examiner*—Nile C. Byers, Jr.

[57] ABSTRACT

The connecting strip is made of a resilient material and is adapted to be inserted into a joint, a connecting element (16) engaging in an undercut groove (9) in the edge-element (7,8) of a joint. A continuous longitudinal notch (13) in the strip facilitates deformation of the connecting element (16). In order to facilitate the installation of the said strip in the sealing position in the joint, the said notch is arranged on the inside of the said connecting element, and the latter is buckled towards the middle of the joint, thus opening the notch. In the ultimate position, the connecting element is straightened and the notch closed.

5 Claims, 7 Drawing Figures

EXPANSION JOINT

The invention relates to a connecting strip more particularly in devices for bridging expansion-joints in bridges or the like structures, the said strip being made of a resilient material having at least one connecting element by means of which it may be inserted, by suitable deformation, into a matching undercut groove in the edge-element of a joint, and comprising a longitudinally continuous notch facilitating the said deformation of the said connecting element.

One known expansion-joint seal of this kind (German Pat. No. OS 1 784 069) consists of an extruded hollow section of resilient material comprising two opposing lateral strips which are inserted into matching grooves in the walls of the joint. Deformation of these strips, during insertion into the grooves is facilitated in that the cross-section of each strip is weakened, in the central portion, by a recess running in the longitudinal direction of the section, located on the outside of the strip facing the base of the grooves in the walls of the joint.

Snapping the lateral parts of the hollow section into the corresponding grooves is difficult and requires a considerable amount of effort, since the parts must be considerably deformed for insertion, and the possibility of using auxiliary tools is limited.

In contrast to this, it is the purpose of the invention to provide a connecting strip which is adapted to be inserted simply, and without the application of a large amount of force, into undercut recesses in the edges of the joint.

According to the invention, this purpose is achieved in that the notch is arranged upon the inside of the connecting element remote from the base of the groove; in that in order to facilitate insertion into the groove in the edge element of the joint, the connecting element is buckled towards the middle of the joint and the notch is open; and in that the said connecting element, in its final position, is at least straight, with the notch closed.

This design makes it possible to snap the connecting element into the relevant groove, with an insignificant amount of deformation of the parts of the section itself. The marked deformation or bending of the connecting elements in known sections is replaced by a toggle action engagement of the connecting element, the sections on each side of the notch being extended towards the base of the groove and then expanding into the undercut sections in the groove. The result of this is that the connecting element is securely seated in the groove in the edge element of the joint, which will also withstand a limited amount of tension.

In one particularly advantageous example of embodiment, the connecting element comprises two continuous longitudinal beads on its narrow sides at a distance from the inside, the said beads engaging in matching undercuts in the grooves in the edge element of the joint. This still further improves the seating of the connecting element in that, on the one hand, there is a locking action in the vicinity of the beads while, on the other hand, it is possible to exert increased pressure upon the narrow sides of the connecting element because the areas outside the beads are kept under preload in the opening in the groove.

Support areas of this kind, in the vicinity of the opening in the groove, are preferably achieved by making the undercuts in the groove deeper than the height of the relevant beads. The connecting element thus snaps towards the base of the groove, where the outer surface of the said element bears, in the vicinity of the notch, against the base of the groove, in addition to the two support areas mentioned above. Although this provides considerable resistance to buckling, it does not make it any more difficult to snap the connecting section out, when required. The seating of the connecting element is characterized by compression thereof in the sense of a preload in a plane approximately parallel with the walls adjacent the joint and with a plane passing through the two beads on the connecting element.

It is possible to improve still further the seating of the connection element in the relevant groove in the edge element of the joint, according to the invention, by making the base of the said groove concave, as seen in cross-section.

There are many uses for the connecting element according to the invention; in connection with the bridging of joints, in particular, the notch may be directly adjacent the underside of a sectional cover uniting two opposing connecting elements.

As an alternative to a one-piece joint between the connecting element and the sectional cover, the notch may have in its interior, an expanded cross-section for the accommodation of an edge-bead on a sectional cover, in the case of a sealing section, on a strip of foil for an insulating connection or the like.

Examples of embodiment of the invention are explained hereinafter in conjunction with the drawing attached hereto, wherein.

Figure 1:
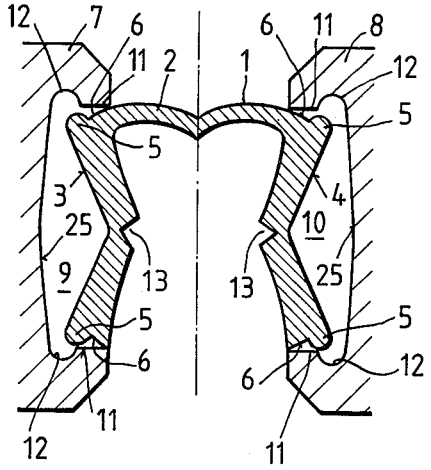
FIG. 1 shows a sealing strip before installation.

Sealing strip 1, shown in cross-section in FIG. 1, comprises a cover 2 and two lateral parts 3,4 in the form of connecting elements. The upper ends of lateral parts 3,4, at the level of the cover, and the narrow sides of the lower ends thereof, have beads 5 projecting respectively upwardly and downwardly. Adjacent the beads on the narrow sides of the lateral parts are bearing surfaces 6 which are set back, in relation to the said beads, towards the interior of the section. These bearing surfaces correspond to upper and lower supporting surfaces 11 at the ends of edge-elements 7,8 of the joint, in the openings of the two grooves 9,10. Beads 5 on sectional sealing strip 1 correspond to undercuts 12 in the said grooves.

Figure 2:
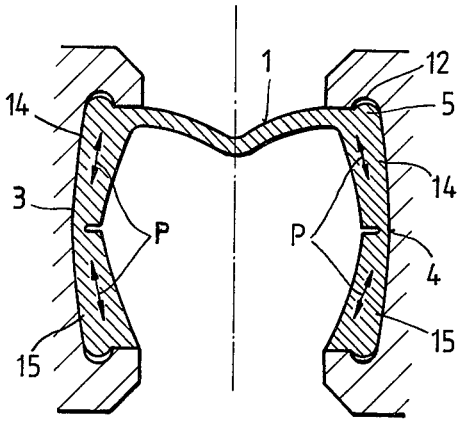
FIG. 2 shows the sealing strip according to FIG. 1 after installation.

Under no load, lateral parts 3,4 of sealing strip 1 are buckled inwardly along continuous notches 13 in the internal surfaces of the said parts. FIG. 2 shows the sealing strip according to FIG. 1 after installation. To this end, lateral parts 3,4 are snapped horizontally outwards, so that beads 5 snap into the matching undercuts in grooves 9,10. In this position upper parts 14 and lower parts 15 of lateral parts 3 and 4 support themselves, in the vicinity of the now closed notch 13, by vertical bracing provided by pressure applied approximately in the direction of arrows P. Particularly effective bearing between the said lateral parts and the undercuts in the grooves, along three bearing lines defined by the intersections of arrows P with the profiled shape of the connecting strip is achieved if beads 5 do not completely fill undercuts 12. After being installed, the sealing strip may be removed again by compressing lateral parts 3,4 vertically.

Figure 5:
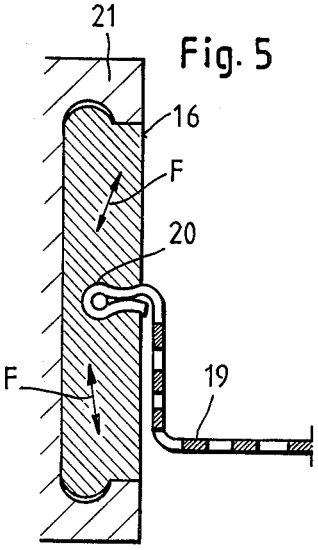
FIGS. 3 to 5 illustrate a connecting element for the accommodation of a strip of foil for an insulating connection before, during and after installation.
Figure 4:
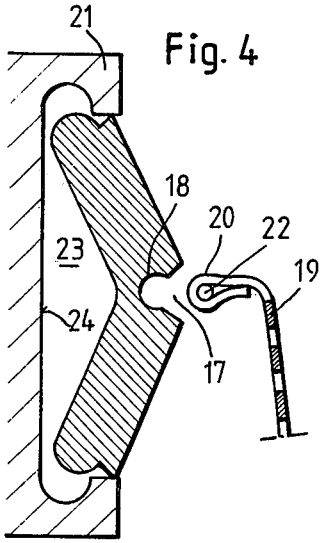
Figure 3:
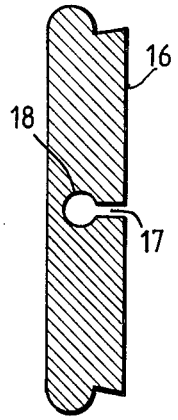

FIG. 3 shows a connecting element 16, the basic design of which corresponds to that of the lateral parts of the sealing strip according to FIGS. 1 and 2, except that it is provided with a notch 17, the inner end of which has a cross-sectionally circular expansion 18. As shown in FIG. 4, connecting element 16 is snapped into place by buckling, as already described in connection with FIGS. 1 and 2. Before this, and as shown in FIG. 4, an edge bead 20, on a strip of foil 19 for an insulating connection, is inserted into expansion 18 in the said notch. When connecting element 16 is straightened, as shown in FIG. 5, edge bead 20 is firmly secured in the vicinity of notch 17. The main direction of the preload forces acting in the interior of connecting element 16 is indicated in FIG. 5 by arrows F. The insulating connection described in FIGS. 3 to 5 is located, for example, on the side of edge element 21 of the joint remote from the gap in the joint, in such a manner that strip 19 of foil lies between a road surface (not shown) thereabove and a concrete surface (not shown) therebelow. Edge bead 20 on the strip of foil, which may be of any desired width, may be produced by wrapping the end of the foil around a circular string 22 to which it may be glued, for example. The edge element of the joint, shown in FIGS. 4 and 5, has a groove 23 having a flat base 24, in contrast to the slightly concave base 25 of the groove according to FIGS. 1 and 2. This provides a desirable inclination of the preload forces (arrows P) which increases the resistance of the section to being pulled out.

It is desirable for the insulating connection according to FIGS. 3 to 5 to be adaptable to any desired thickness of road surface. The separation between the insulating part and the connecting part makes it possible to select the most appropriate material for each purpose, thus simplifying production and storage.

Figure 7:
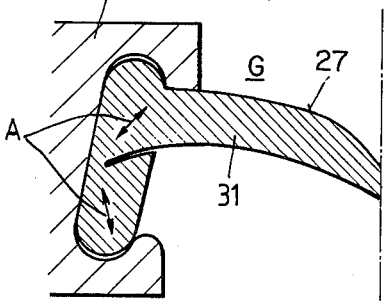
FIGS. 6 and 7 shows half a sealing strip during and after installation.
Figure 6:
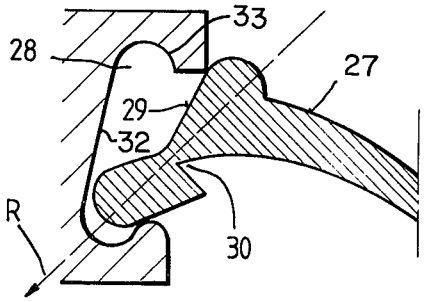

FIGS. 6 and 7 illustrate an edge element 26 having a groove 28 open towards gap G in the joint into which a sealing strip 27, only one half of which is shown, in cross-section, having a particularly small connecting element 29, is inserted. FIG. 6 shows the said connecting element before it is inserted, i.e. with notch 30 still open, dotted arrow R indicating the direction of installation. The groove 28 is provided with a base 32 and undercuts 33 to receive the beaded ends of the connecting element. In the installed position illustrated in FIG. 7, notch 30 is closed, i.e. cover 31 is supported from below. The direction of the preload forces is indicated by arrows A.

We claim:

1. A connecting strip, more particularly in devices for bridging expansion-joints in bridges or the like structures, the said strip being made of a resilient material having at least one connecting element by means of which it may be inserted, by deformation, into a matching undercut groove in the edge-element of a joint, and comprising a longitudinally continuous notch which facilitates the deformation of the said connecting element, characterized in that the notch (13, 17,30) is arranged on the inside of the connecting element (3,4,16,29) remote from the base (24,25,32) of the groove; in that in order to facilitate insertion into the groove (9,10,23,28) in the edge-element (7,8,21,26) of the joint, the said connecting element is buckled towards the middle of the joint, thus opening the said notch; and in that the said connecting element, in its ultimate position, is at least straight, with the notch closed.

2. A connecting strip according to claim 1, characterized in that the connecting element comprises two continuous longitudinal beads on its narrow sides at a distance from the inside, the said beads engaging in matching undercuts (12) in the grooves (9,10) in the edge-element (7,8) of the joint.

3. A connecting strip according to claim 2, characterized in that the undercuts (12) in the grooves (9,10) are deeper than the height of the relevant beads (5).

4. A connecting strip according to one of claims 1 to 3, characterized in that the notch (30) is immediately adjacent the underside of a cover (31) uniting two opposing connecting elements (FIGS. 6 and 7).

5. A connecting strip according to one of claims 1 to 3, characterized in that the interior of the notch (17) has an expanded cross-section for the accommodation of an edge-bead (20) on a cover, in the case of a sealing profile, on a strip of foil (19) for an insulating connection or the like.

* * * * *